United States Patent [19]

Jacobs

[11] 3,951,569

[45] Apr. 20, 1976

[54] AIR CONDITIONING COMPRESSOR

[75] Inventor: James W. Jacobs, Dayton, Ohio

[73] Assignee: General Motors Corporation, Detroit, Mich.

[22] Filed: May 2, 1975

[21] Appl. No.: 573,849

[52] U.S. Cl. ..... 417/269; 417/275; 417/284; 417/292; 417/309

[51] Int. Cl.[2] ..... F04B 1/12; F04B 49/00

[58] Field of Search ..... 417/269, 274, 275, 292, 417/309, 507, 284

[56] References Cited

UNITED STATES PATENTS

| | | | |
|---|---|---|---|
| 3,261,541 | 7/1966 | Kocher | 417/309 |
| 3,301,470 | 1/1967 | Larsen et al. | 417/309 |
| 3,313,530 | 4/1967 | Bicklaus et al. | 417/292 |
| 3,385,508 | 5/1968 | Shaw | 417/309 |
| 3,759,057 | 9/1973 | English et al. | 417/292 |
| 3,884,597 | 5/1975 | Ito | 417/284 |

*Primary Examiner*—William L. Freeh
*Assistant Examiner*—G. P. LaPointe
*Attorney, Agent, or Firm*—Kenneth H. MacLean, Jr.

[57] ABSTRACT

A piston type compressor for use with an automotive air conditioning system with the capabilities of successfully operating over a wide range of ambient temperatures including apparatus to automatically modify the compressor displacement in response to operating conditions. The effective displacement of the compressor is decreased in response to decreasing ambient temperatures to prevent an excess of compressor capacity over the cooling capacity of the evaporator at that temperature. The modulating apparatus includes pressure responsive valving mounted in the piston to monitor inlet pressure which correspond to operation during low ambient temperatures.

3 Claims, 4 Drawing Figures

AIR CONDITIONING COMPRESSOR

This invention relates to compressors particularly for use with automotive air-conditioning systems and to modulating apparatus which automatically changes the compressor's effective displacement in response to operating conditions.

Basically, the disclosed compressor is an improved piston type compressor of the general type covered by U.S. Pat. No. 3,057,545 to Ransom which issued Oct. 9, 1962 and is assigned to the General Motors Corporation. The Ransom patent discloses a housing having a drive shaft extending therethrough and axially aligned cylinder bores therein. Dual ended pistons are supported within the cylinder bores and are axially reciprocated by movement of the inclined surface on a swash plate attached to the drive shaft. The Ransom patent has a constant effective displacement at any given rotative speed and no means are provided to vary the displacement in accordance with cooling demands on the air conditioning system.

An automotive air conditioning system is expected to operate successfully under severe conditions, particularly over a wide range of ambient temperatures. When the ambient temperature is relatively high, say over 90° F., the air flowing over the exterior surfaces of the evaporator is relatively warm and a relatively large heat transfer takes place between the refrigerant and the air. Under these conditions, a compressor with a relatively large pumping capacity is needed to provide a sufficient volume of refrigerant to the evaporator for proper and desirable cooling. Under these high ambient temperature conditions, the heat transfer is sufficient to vaporize the large quantity of liquid refrigerant and thereby to maintain refrigerant pressure above a level corresponding to freezing temperatures. This prevents the exterior surfaces of the evaporator from falling below 32° F. and the formation of frost thereon.

During periods of operation when the ambient temperature is relatively low, say about 70° F., the pumping capacity of the compressor which was needed on a relatively hot day greatly exceeds the heat load on the evaporator at the lower temperature. Therefore, there may be insufficient heat transferred from the air to the refrigerant to produce complete vaporization of the relatively large quantity of liquid refrigerant delivered to the evaporator. It is common to select a compressor so that its pumping capacity is sufficient to accommodate desirable operation of the air conditioning system under high ambient temperatures. This relatively large compressor pumps sufficient refrigerant to rapidly cool down the passenger compartment of an automobile within a reasonable time. However, the large compressor capacity then is greatly in excess of that needed for operation of the system on a milder day. As a result, the compressor will flood the evaporator with liquid refrigerant and consequently the refrigerant pressure and temperature in the evaporator will decrease. When this happens, frost may accumulate on the evaporator and may even block air flow through the evaporator.

It is thereby desirable to utilize a compressor in which the displacement is automatically decreased in accordance with decreasing ambient temperatures. This permits operation of the air conditioning system under low ambient temperature conditions when relatively little pumping capacity is needed and still providing sufficient capacity to handle the cooling operation under high ambient temperature conditions. The present patent application discloses preferred embodiments of an automatically modulated variable displacement compressor. Both embodiments include a unique piston structure which is compatible with compressors of the Ransom-type previously mentioned. Therefore, the Ransom-type compressor may be economically converted into variable capacity air conditioning compressors according to the teaching of the subject patent application. An advantage of the subject invention other than its versatility, are the simple and compact structure disclosed to achieve automatic displacement changes.

Specifically, piston modifications include provision of a pressure responsive valve means therein which upon sensing low inlet pressures permits bleeding off a portion of the volume of the compression chamber during the compression stroke and subsequent re-expansion into the compression chamber during an inlet stroke. This effectively decreases the pumping capacity of the compressor by decreasing its pumping efficiency. The advantages of this method are many. Previous compressors of this type may be modified by substituting the improved pistons of the subject compressor for the original pistons. Also, the modified pistons with the pressure responsive valve means are simple in structure and compact and therefore the addition of the pistons of this type to a compressor would not involve a substantial cost increase. Also, the valve structures have few parts and thereby should be highly reliable and durable as compared to more complicated ways of providing variable displacement.

Further advantages and features of the subject invention will become more apparent from the following detailed description of the two illustrated embodiments which are shown in the following drawings.

Figure 1:
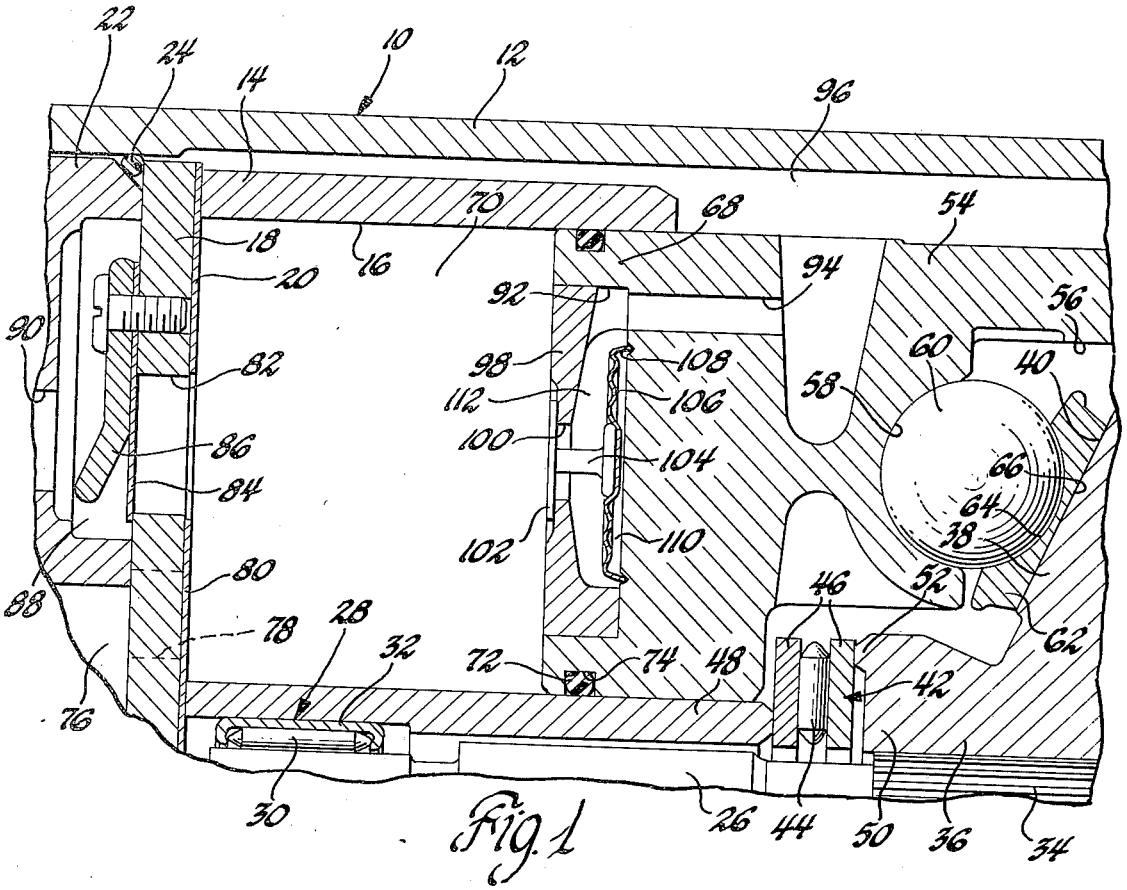
FIG. 1 is a fragmentary sectioned view of a variable displacement piston type compressor with one end of the piston shown at the beginning of the compression stroke or the end of the intake stroke during operation under high ambient temperature conditions.
Figure 2:
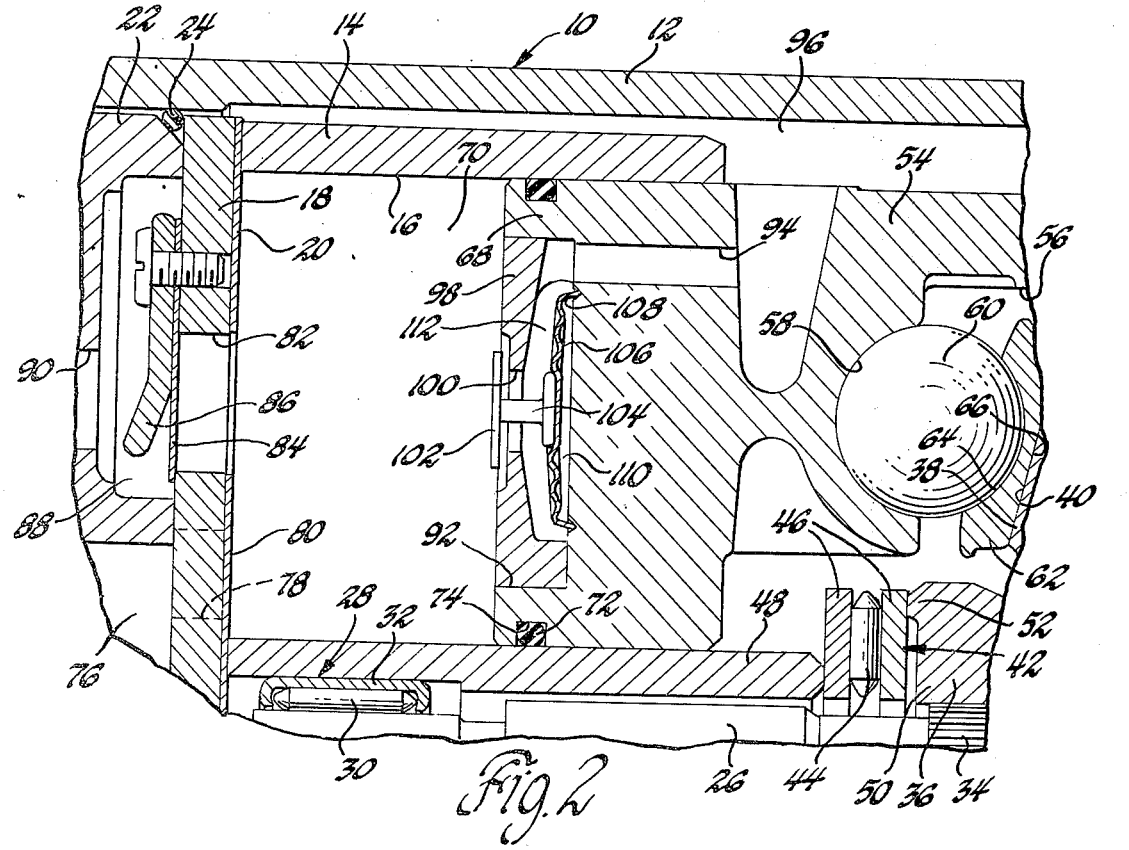
FIG. 2 is a view similar to FIG. 1 and showing the position of the piston near the bottom of its inlet stroke or the beginning of its compression stroke when the air conditioning system is operated during low ambient temperature conditions.

In FIGS. 1 and 2 of the drawings, a first embodiment of a compressor 10 with automatically variable displacement is illustrated. The compressor is not shown in its entirety in view of the fact that the illustrated compressor is basically an immprovement of the piston structure of the Ransom-type patent which was previously referred to. Compressor 10 includes an outer cylindrical housing 12 which encircles a cylinder block 14 and has at least one axially aligned cylinder bore 16 therein. The ends of cylinder block 14 are covered by a valve plate 18 and an intake reed plate 20. A cylinder head 22 is secured in the end of the housing 12 to position and hold the members 14, 18 and 20 within the housing. An O-ring 24 between members 14, 18 and 22 prevents refrigerant leakage therebetween from the interior of housing 10. The cylinder head 22 may be attached to housing 10 by welding or brazing or by other fastening means.

A drive shaft 26 extends through the housing 10 and cylinder block 14 and is supported near its ends. One end of the drive shaft 26 extends through one of the cylinder heads to the exterior of the compressor 10 and is adapted to be attached to a pulley assembly for receiving a rotative torque input. In the drawings, the drive shaft 26 is supported by bearing assembly 28. The bearing 28 includes a plurality of cylindrical needle bearing members 30 which are encircled by a raceway 32. At a midportion of drive 26, an enlarged portion 34 has axially extending shallow grooves therein adapted to fasten a swash plate member 36 therearound. Swash plate member 36 includes a circular portion 38 having flat faces 40 which are inclined with respect to a plane normal to the axis of the drive shaft 26. A thrust bearing assembly 42 which includes needle bearings 44 and raceways 46, is located between a central portion 48 of the cylinder 14 and a ridge 52 on hub portion 50 of the swash plate 38.

One half of piston 54 is illustrated in FIGS. 1, 2 and a central cutout portion 56 is shown which straddles the edge of swash plate 38. Piston 54 has spherical sockets 58 which support spherical bearings 60 on either side of the swash plate. The spherical bearings 60 engages thrust bearing shoes 62 each with a spherical socket portion 64 on one side and a flat surface 66 on the other side. Rotation of shaft 26 within housing 12 causes the swash plate 36 to move the inclined faces 40 axially back and forth and thereby to reciprocate piston 54 within bore 16.

As the end portion 68 of piston 54 is reciprocated to the right and to the left in bore 16, refrigerant is compressed within the compression space or chamber 70. An O-ring 72 within an annular groove 74 in piston 54 engages the walls of bore 16 to prevent refrigerant leakage between the piston 54 and the cylinder member 14. When the piston 54 is moved to the right, refrigerant is drawn from an inlet chamber 76 in head 22 through an inlet opening 78 in the valve plate 18. The refrigerant is then drawn past an inwardly flexible finger like inlet valve 80 which is an integral part of the inlet reed plate 20. When piston 54 moves to the left, the compressed refrigerant passes through an outlet port 82 and past an outwardly flexible finger like valve 84 supported by a backup member 86. Refrigerant then flows into an outlet chamber 88 and subsequently passes through a passage 90 in the cylinder head 22. The aforedescribed operation of the compressor 10 corresponds to operation in a relatively high ambient termperature environment during which maximum compressor capacity is needed. However, during operation in a relatively low ambient temperature environment, full displacement of the compressor is unnecessary and causes a quantity of liquid refrigerant to collect in the evaporator. Resultantly, the temperature of the evaporator may drop below freezing levels.

The subject improved compressor utilizes a piston with a recess 92 in the piston end and a bypass 94 which extends from the recess to a sump chamber 96 of the compressor. The sump is a relatively low pressure region defined within housing 12 by the cylinder block 14 and pistons 54 and being connected to the inlet chamber 76. A valve seat member 98 extends across the mouth of the recess 92 and includes an opening 100 fluidly connecting the compression chamber 70 with the bypass 94. The opening 100 is normally covered by an overlying portion 102 of a poppet valve member 104. The other end of the poppet valve member 104 is attached to the central portion of a generally flat diaphragm member 106. The outer peripheral edge of the diaphragm 106 is secured by brazing to the piston 54 within a groove 108. This forms a sealed enclosure 110 adapted to be charged with some relatively inactive gas, such as nitrogen. The bellows 106 responds to pressure changes in bypass 94 by volumetric expansion and contraction. The pressure changes are communicated through the sump 96 from the inlet 76. When the inlet pressure decreases, the diaphragm 106 and valve 104 are moved to the left as shown in FIG. 2 to cause the valve portion 104 to uncover opening 100 in the valve seat member 98 and permit refrigerant to flow between the compression chambers 70 and the sump 96 during a portion of the inlet and compression strokes. The quantity of gas in the enclosure 110 is adjusted to cause valve 104 to open and permit flow through opening 100 when the pressure within the enclosure 112 to the left of the diaphragm has fallen below a level corresponding to freezing temperatures of the evaporator.

The condition of valve 104 as shown in FIG. 1 represents the position assumed near the end of an intake stroke or at the beginning of a compression stroke when the air conditioning system is operated in a relatively high ambient temperature environment. In this position, maximum pumping capacity of the compressor can be utilized. The condition of valve 104 in FIG. 2 represents the position assumed near the last of the intake stroke or the beginning of the compression stroke when the air conditioning system is operated in a relatively low ambient temperature environment. During this period of operation, relatively low pumping capacity is desirable. The low inlet pressure as communicated through the sump to the enclosure 112 causes the valve 104 to be moved leftward to open passage 100 during portions of the intake and compression strokes. This reduces the effective displacement of the compressor in that a portion of the stroke is utilized to pump refrigerant back and forth between the compression chamber and the sump. In addition, the decrease in pumping capacity is accompanied by a decreased power input needed to rotate the compressor thus enhancing the efficiency of the air conditioned vehicle during low ambient temperature operation.

Figure 3:
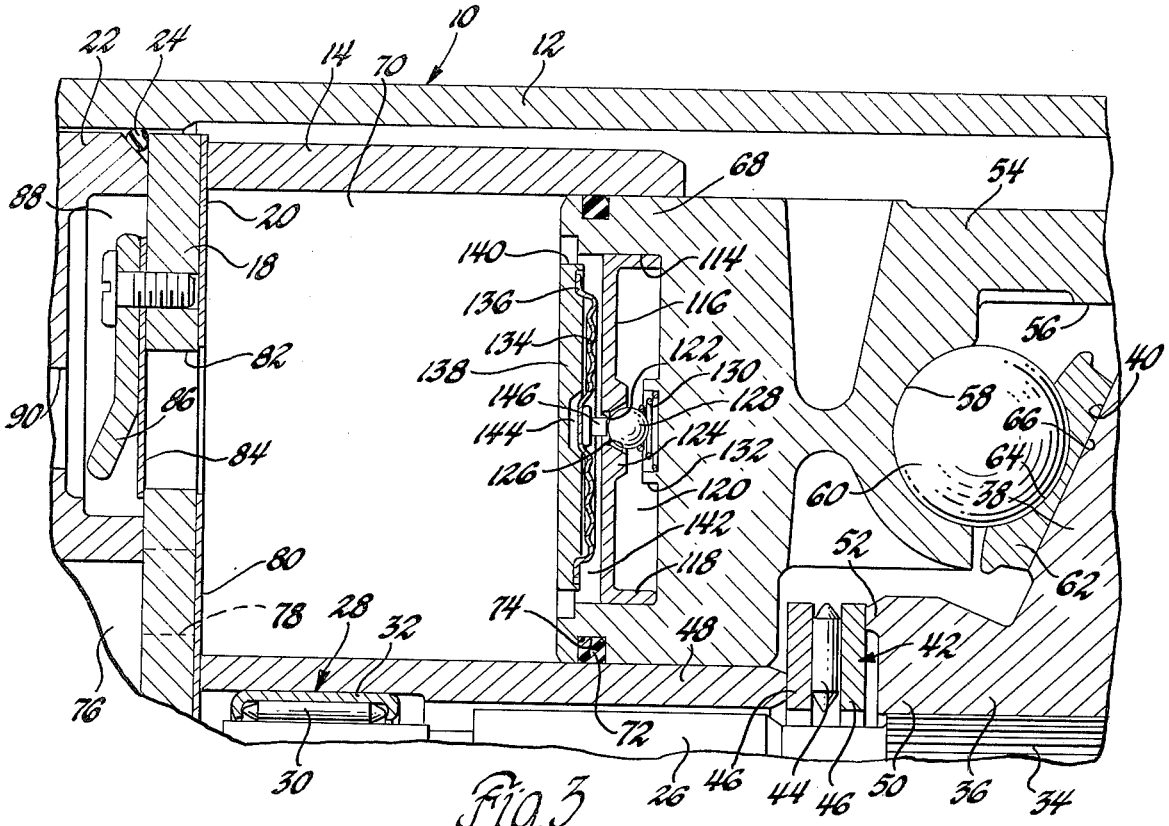
FIG. 3 is a fragmentary sectioned view of a second embodiment of the compressor with one end of the piston located at the completion of the intake stroke or the beginning of the compression stroke during operation of the system under relatively low ambient temperatures.
Figure 4:
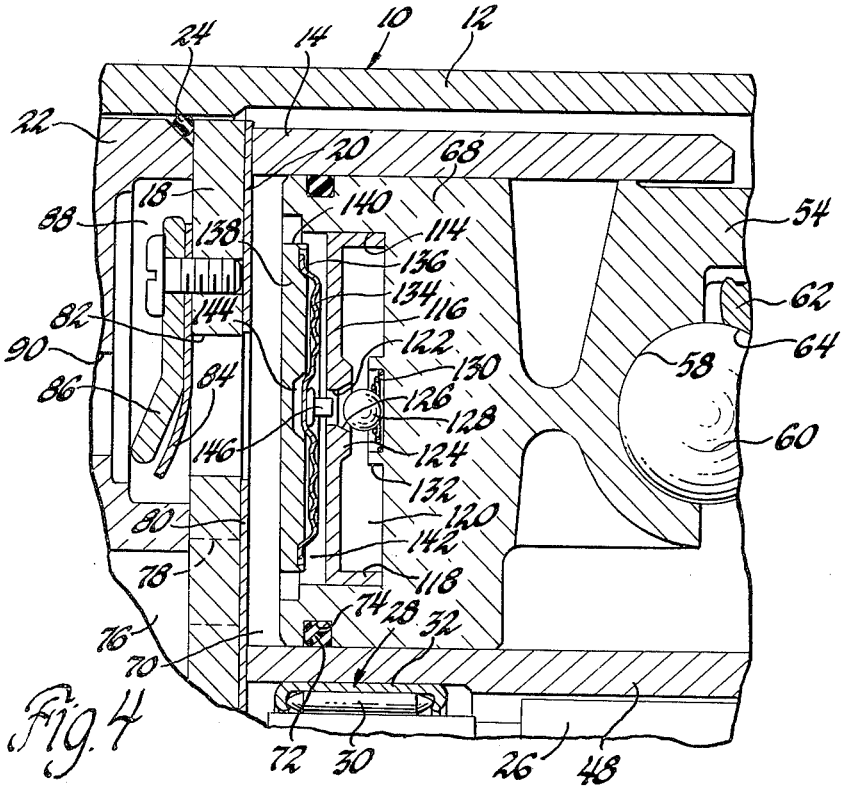
FIG. 4 is a view similar to FIG. 3 but showing the piston near the end of the compression stroke during operation of the system under relatively low ambient temperature conditions.

A second embodiment of the compressor is illustrated in FIGS. 3 and 4 which has many identical parts as the compressor shown in FIGS. 1 and 2. Consequently, identical portions of the compressors have been assigned the same numerals and reference to the previous description is relied upon for their structure and functional operation. The compressor shown in FIGS. 3, 4 includes a recess 114 formed in the end of head 68 of piston 54. A partition or wall forming member 116 covers the mouth of the recess and has an inwardly turned edge portion 118 which fits tightly within the recess 114 to define an enclosure 120. An opening or port 122 in the wall 116 interconnects the compressor chamber 70 and the enclosure 120. A portion 124 surrounding opening 122 has a conical bore therein which presents a valve seat surface 126. A spherical check valve 128 is normally biased into engagement with the valve seat surface 126 by a spring 130 with one end of the spring 130 engaging the valve 128 while the other end is supported within a lip 132 on the piston. During normal operation of the compressor, the piston 54 is moved to the left during a compression stroke as shown in FIG. 4 until a predetermined pressure differential across valve 128 causes the valve 128 to move against spring 130 to permit a flow of refrigerant through port 122 from the compression chamber 70 into storage enclosure 120. Subsequently, when piston 54 moves to the right during an intake stroke, the reduced pressure in the compression chamber 70 permits spring 130 to move valve 128 against seat 126 to trap pressurized refrigerant in enclosure 120.

Less than maximum compressor capacity is desired during low ambient temperature operation and a diaphragm member 134 is provided to sense refrigerant pressures. The diaphragm is supported at its outer peripheral edge 136 by wall or cover member 138 which is attached at a peripheral edge to the piston 54 in overlying spaced relation to wall 116. A plurality of openings or ports 140 are spaced around the peripheral edge of wall 138 to permit refrigerant flow from compressor chamber 70 to the space 142 on the rightward side of diaphragm 134. The diaphragm 134 and member 138 forms a sealed space 144 therebetween which is filled with a predetermined charge of relatively inert gas such as nitrogen. Attached to the central portion of diaphragm 134 is a valve actuator 146 extending toward the check valve 128. A decrease in pressure within the chamber 142 causes the diaphragm 134 to move rightward toward the check valve 128 and engage actuator 146 with valve 128 to unseat the valve and to permit the escape of high pressure refrigerant stored in enclosure 120 into the compression chamber 70.

In FIG. 3, the position of piston 54 is shown at the end of the intake stroke and the beginning of the compression stroke during operation in a relatively low ambient temperature environment. The resultant low inlet pressure within inlet 76 and the compression chamber 70 causes the diaphragm 134 and actuator pin 146 to move against valve 128 and open the passage 122. The opening of passage 122 releases high pressure refrigerant previously stored in the enclosure space 120. Near the end of the subsequent compression stroke, the enclosure space 120 is once again recharged with pressurized refrigerant as shown in FIG. 4. This alternate charging and recharging of enclosure space 120 by refrigerant from the compression chamber 70 effectively decreases the pumping capacity of the compressor. As previously mentioned, this is desired during operation in a low ambient temperature environment.

Although the illustrated embodiments are preferred embodiments to achieve the objectives pointed out earlier in the specification, it is to be understood that modifications may be made which will not fall without the scope of the following claims which define the invention claimed herein.

What is claimed is as follows:

1. A piston type compressor for use in an air conditioning system comprising: a housing defining at least one cylinder bore with an end portion covering the cylinder bore; a piston supported for reciprocation within the cylinder bore and defining in conjuction with the end member and the cylinder bore a variable volume compression chamber, said housing having a valved inlet passage for controlling the flow of refrigerant into the compression chamber in response to suction within the compression chamber caused by movement of the piston during an intake stroke and also having a valved outlet passage for controlling the flow of refrigerant from the compression chamber in response to increased pressure therein caused by movement of the piston during a compression stroke; said piston having passage means therein fluidly connected to said compression chamber to permit a limited flow of refrigerant into said compression chamber during an intake stroke and a limited flow from said compression chamber during a compression stroke; valve means associated with said piston passage means for controlling the flow of refrigerant therethrough as said piston is reciprocated within said cylinder bore; valve actuator means on said piston including a movable diaphragm which forms a part of a sealed enclosure which is filled with a fluid characterized by relatively limited pressure and volume changes in response to temperature changes whereby said diaphragm moves primarily in response to pressure changes of the refrigerant at the compressor inlet; means operably connecting said valve means and said movable diaphragm to open said piston passage whenever a refrigerant pressure level corresponding to freezing temperatures produces volumetric expansion of said sealed enclosure and corresponding movement of said diaphragm.

2. A piston type compressor for use in an air conditioning system comprising: a housing defining at least one cylinder bore with an end portion covering the cylinder bore; a piston supported for reciprocation within the cylinder bore and defining in conjunction with the end member and the cylinder bore a variable volume compression chamber, said housing having a valved inlet passage for controlling the flow of refrigerant into the compression chamber in response to the suction within the compression chamber caused by movement of the piston during an intake stroke and also having a valved outlet passage for controlling the flow of refrigerant from the compression chamber in response to increased pressure therein caused by movement of the piston during a compression stroke; first enclosure means including a passage in said piston fluidly connected to said inlet for conducting a limited flow of refrigerant into and from said compression chamber independently of said inlet passage; valve means to control the flow of refrigerant through said piston passage as said piston is reciprocated within said cylinder bore; a valve actuator on said piston including a movable diaphragm one side of which is exposed to refrigerant in said first enclosure at a pressure level corresponding to the inlet pressure level and having a peripheral edge attached in a fluid tight manner to another portion to form a sealed enclosure filled with a predetermined quantity of a fluid characterized by relatively limited pressure and volume changes in response to temperature changes whereby said diaphragm moves primarily in response to pressure changes of refrigerant at the compressor inlet; means operably connecting said valve means and said movable diaphragm to move said valve means and open said piston passage whenever a refrigerant pressure level within said first enclosure corresponding to freezing temperatures produces volumetric expansion of said sealed enclosure and corresponding movement of said diaphragm.

3. A piston type compressor for use in an air conditioning system comprising: a housing defining at least one cylinder bore with an end portion covering the cylinder bore; a piston supported for reciprocation within the cylinder bore and defining in conjunction with the end member and the cylinder bore a variable volume compression chamber; said housing having a valved inlet passage for controlling the flow of refrigerant into the compression chamber in response to suction within the compression chamber caused by movement of the piston during an intake stroke and also having a valved outlet passage for controlling the flow of refrigerant from the compression chamber in response to increased pressure therein caused by movement of the piston during a compression stroke; means attached to the end of said piston defining an enclosure for the storage of pressurized refrigerant; said storage enclosure having an opening therein to permit refrigerant to pass between the compression chamber and said storage enclosure; valve means overlying said opening to control a limited flow of refrigerant from and into the compression chamber respectively during compression and intake strokes of said piston; said valve means normally being biased into a closed operative position to trap pressurized refrigerant within said storage enclosure and being movable to an open position permitting refrigerant flow into said storage enclosure when the pressure in said compression chamber is greater than the pressure within said storage enclosure; valve actuator means on said piston including a diaphragm with a movable portion which forms a part of a sealed enclosure one side of which is exposed to refrigerant in said compression chamber, said sealed enclosure being filled with a fluid characterized by a relatively limited pressure and volume response to temperature changes whereby said diaphragm moves primarily in response to pressure changes of refrigerant from the compressor inlet; said valve actuating means further including a connecting member moved by said movable portion of said diaphragm in response to a decrease in refrigerant pressure toward said valve means to unseat said valve means and release pressurized refrigerant from said storage enclosure whenever a refrigerant pressure level corresponding to freezing temperatures produces volumetric expansion of said sealed enclosure and corresponding movement of said diaphragm.

* * * * *